US007058348B2

(12) United States Patent
Aslam et al.

(10) Patent No.: US 7,058,348 B2
(45) Date of Patent: Jun. 6, 2006

(54) PRODUCING AN ENHANCED GLOSS TONER IMAGE ON A SUBSTRATE

(75) Inventors: Muhammed Aslam, Rochester, NY (US); Dinesh Tyagi, Fairport, NY (US); Rodney R. Bucks, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 6 days.

(21) Appl. No.: 10/896,396

(22) Filed: Jul. 22, 2004

(65) Prior Publication Data

US 2005/0244202 A1 Nov. 3, 2005

Related U.S. Application Data

(63) Continuation-in-part of application No. 10/837,050, filed on Apr. 30, 2004.

(51) Int. Cl.
*G03G 15/20* (2006.01)

(52) U.S. Cl. ..... 399/341; 399/324

(58) Field of Classification Search ..... 399/341
See application file for complete search history.

(56) References Cited

U.S. PATENT DOCUMENTS 5,234,783 A 8/1993 Ng ..... 430/45
5,256,507 A 10/1993 Aslam et al. ..... 430/42
5,339,146 A 8/1994 Aslam et al. ..... 355/285
5,716,750 A * 2/1998 Tyagi et al. ..... 430/124
5,970,301 A * 10/1999 De Cock ..... 399/341
6,223,005 B1 * 4/2001 Rush et al. ..... 399/45
6,879,802 B1 * 4/2005 Manleitner ..... 399/325
2003/0007814 A1 * 1/2003 Richards ..... 399/341
2003/0223792 A1 * 12/2003 Chen et al. ..... 399/341
2003/0235683 A1 12/2003 Tamagawa et al. ..... 428/195.1
2004/0081489 A1 * 4/2004 Noya et al. ..... 399/328

FOREIGN PATENT DOCUMENTS

EP 1 403 724 A2 3/2004

* cited by examiner

*Primary Examiner*—David Gray
*Assistant Examiner*—Ryan D. Walsh
(74) *Attorney, Agent, or Firm*—Lawrence P. Kessler; Donna Suchy

(57) ABSTRACT

Producing an enhanced gloss electrophotographic toner image on a substrate by coating colored fusible toner particles supported on a substrate with a layer of clear toner containing an offset preventing wax, transporting the substrate bearing clear toner coated colored fusible toner particles through a fuser zone to fuse the fusible toner particles and produce a substrate bearing a fused clear coated toner image, and transporting the substrate bearing the clear coated fused toner image through downstream glossing device to re-fuse the fused toner image to increase the gloss of the previously fused toner image.

15 Claims, 1 Drawing Sheet

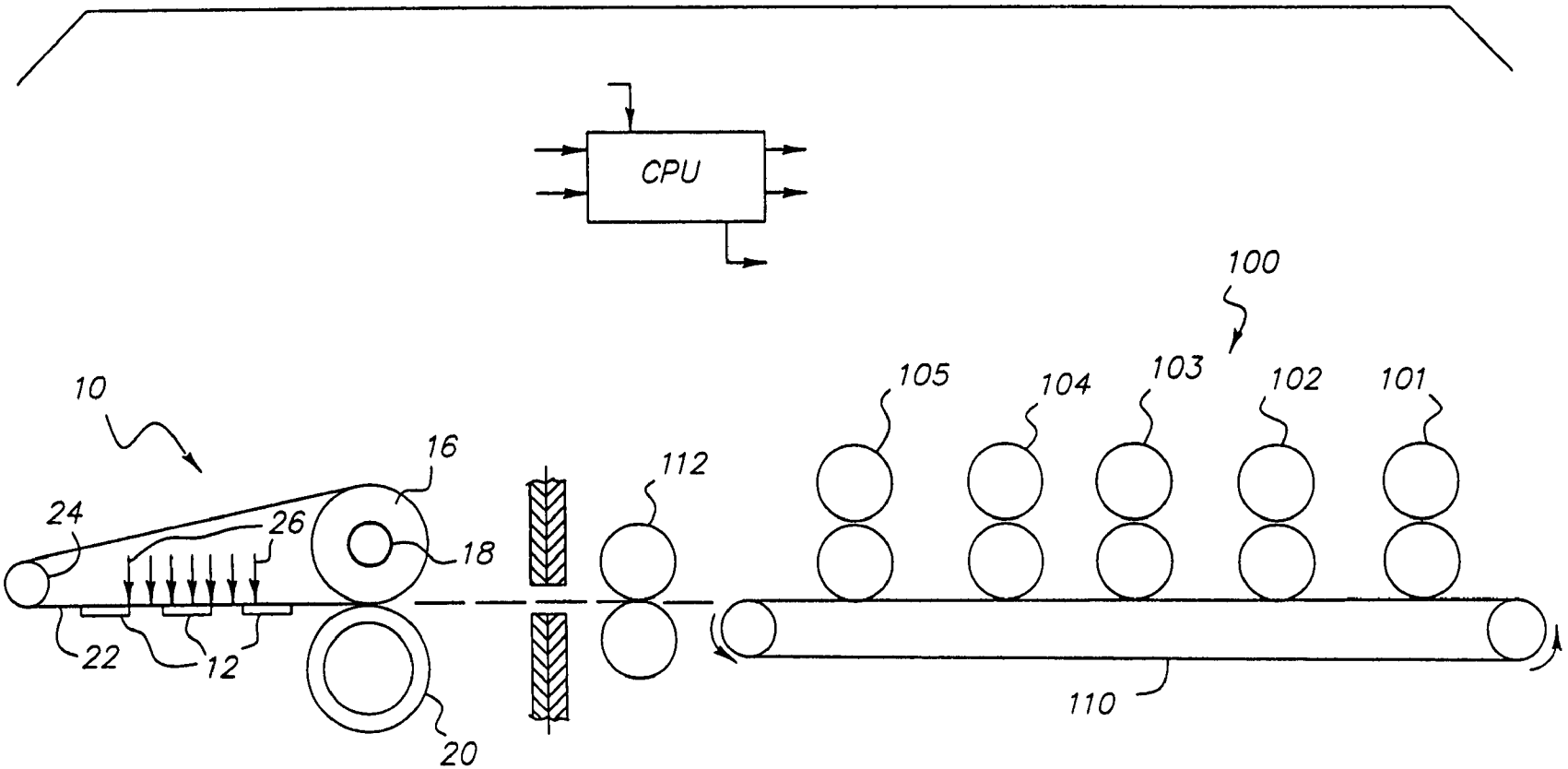
CPU
100
101
102
103
104
105
110
112
16
18
20
10
24
26
12
22

PRODUCING AN ENHANCED GLOSS TONER IMAGE ON A SUBSTRATE

CROSS-REFERENCE TO RELATED APPLICATIONS

This is a Continuation-In-Part of U.S. patent application Ser. No. 10/837,050, filed on Apr. 30, 2004, by Muhammed Aslam et al., entitled: A METHOD FOR PRODUCING AN ENHANCED GLOSS TONER IMAGE ON A SUBSTRATE.

FIELD OF THE INVENTION

This invention relates to selectively producing an enhanced gloss electrophotographic toner image on a substrate by passing a substrate bearing a pre-fused image of colored fusible toner particles through a downstream glossing device. When the glossing device is to be used, the fusible colored toner particle image is covered by a fusible clear toner layer, that does not require use of a release oil to prevent offset.

BACKGROUND OF THE INVENTION

Various methods are known for fusing toner particle images on substrates. In conventional fusing systems, one or both of the fuser roller and the pressure roller may be heated and are somewhat compliant to create a wide nip to allow sufficient heating area. Such conventional fusing systems typically provide gloss levels less than about 20 at a 20° measurement measured by the Glossgard II 20° glossmeter as discussed below. Also when using coated papers, the wide nip causes overheating and thereby contributes to blisters as the receiving sheet leaves the nip. Unfortunately, the wide nip prevents obtaining sufficiently high pressure to remove the toner image relief in these materials.

Finishing color images of fusible toner particles has been attempted in typical fusing systems. In these fusing systems, as noted above, typically the gloss is relatively low. As a result systems for fusing colored images using methods and apparatus that are appropriate for fusing the black images to the substrate, do not provide the desired gloss. Alternate methods have been used to produce enhanced gloss images by fusing the toner particle images and, thereafter transporting the substrate bearing the fused toner image through a cooling zone and then passing the cooled substrate bearing the fused toner image to a release zone where the cooled substrate bearing an enhanced gloss image is released from the transport. In typical fusing processes it has been found that when conventional toners are used, the use of release additives such as silicone oil are required. The oil results in the presence of defects in the color image and in the surrounding area of the substrate when the alternate methods are used. There are a variety of reasons for these defects and it is considered that certain of these defects relates to the formation of a haze, which is a low color saturation area or dot in the image visible from certain viewing angles and under certain lighting conditions. This defect results in lower gloss and reduced image density.

A second defect resulting from the presence of the release oil is oil-laden images (ghosts). The oil presence on an imaged and fused sheet diffuses unevenly into the sheet fibers. Therefore when such a fused sheet comes in contact with a glossing belt, it leaves an oil imprint relating to the image on the belt, which is picked up by the following sheet showing a ghost image of the images of the preceding sheet.

Ripples and wiggles are also attributed to the presence of release oil on the sheet since it reduces friction on the belt glosser nip and therefore can cause image ripples or wrinkles in the sheet.

Various processes for using belt fusers to produce higher gloss images on substrates are shown in U.S. Pat. Nos. 5,089,363; 5,256,507; 5,258,256; and 5,778,295. These patents are hereby incorporated in their entirety by reference and disclose apparatus and methods for the use of belt fusers to improve the gloss of the image on substrates especially in, but not limited to, colored images. These references also disclose various materials conventionally used in such processes.

Accordingly, a continuing effort has been directed to the development of a belt glosser to fuse, cool and release a substrate bearing a pre-fused toner image so that the gloss of the image may be enhanced without the need for or the detrimental effects of release oil.

According to the present invention, an enhanced gloss image is obtained without the use of, or detriments induced by, release oil by selectively producing an enhanced gloss electrophotographic toner image on a substrate by passing a substrate bearing a pre-fused image of colored fusible toner particles through a downstream glossing device. When the glossing device is used, color fusible toner particles are covered by a clear toner layer, that does not require use of a release oil to prevent offset. The clear toner includes from about 2.5 to about 10 weight % of an aliphatic, olefinic, hindered or unhindered ester wax having a molecular weight of typically less than about 2000. This material serves readily to prevent the clear toner from adhering to the surface of the fuser roller of the color printer and of the glossing device, and produces a high gloss image without defects.

BRIEF DESCRIPTION OF THE DRAWING

The FIGURE is a schematic diagram of a belt glossing device, according to this invention, downstream of a color printing apparatus, for substrates bearing a pre-fused toner image, including a clear toner layer overcoat, where the clear toner does not require a release oil to prevent offset, so that the image can selectively be given a higher gloss.

DETAILED DESCRIPTION OF THE INVENTION

In the practice of the present invention, conventional pigmented toners may be used, in conventional printing apparatus, to produce image prints.

A wide variety of polymers useful as binders, are known. Particularly useful are vinyl addition polymers, which may be linear, branched or lightly cross-linked. The most widely used condensation polymers are polyesters, which are polymers in which backbone recurring units are connected by ester linkages. Like the vinyl addition polymers, polyesters useful as binder polymers in toner particles can be linear, branched or lightly cross-linked. They can be fashioned from any of many different monomers, typically by polycondensation, or monomers containing two or more carboxylic acid groups (or derivatives thereof, such as anhydride or ester groups) with monomers containing two or more hydroxy groups. Specific examples of useful binder polymers include: olefin homopolymers and copolymers, such as polyethylene, polypropylene, polyisobutylene, and polyisopentylene; polyfluoroolefins such as polytetrafluorethylene, polyhexamethylene adipamide, polyhexamethylene sebacamide and polycaprolactam; acrylic resins, such as polymethylmethacrylate, polyacrylonitrile, polymethylacrylate, polyethylmethacrylate, and styrene-methymethacrylate; or ethylene-methyl acrylate copolymers, ethylene ethyl acrylate copolymers, ethylene-ethyl methacrylate copolymers, polystyrene, and copolymers of styrene with unsaturated acrylic monomers of the type mentioned hereinbefore; cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride; and vinyl acetate and polyvinyl butyral, polyvinyl alcohol, polyvinyl acetal, ethylene-vinyl acetate copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers; and polyoxymethylene polycondensation polymers, such as polyesters, polyurethane, polyamides, and polycarbonates.

Conventional binders may be used in the toners of the present invention as well known to those skilled in the art. Further numerous colorant materials are well known for use for the production of colors based upon the use of magenta, cyan, yellow, and black colorants. Examples of such colorants are Hansa Yellow G (C.I. 11680), C.I. Yellow 12, C.I. Solvent Yellow 16, C.I. Disperse Yellow 33, Nigrosine Spirit Soluble (C.I. 50415), Chromogen Black ETOO (C.I. 45170), Solvent Black 3 (C.I. 26150), Fuchsine N (C.I. 42510), C.I. Pigment Red 22, C.I. Solvent Red 19, C.I. Basic Blue 9 (C.I. 52015), Quinacridone C.I. Pigment Red 122 and 202, Lithol Rubine C.I. Pigment Red 57:1, C.I. Pigment Red 146, C.I. Pigment Yellow 185, C.I. Pigment Yellow 180, and Pigment Blue 15. Carbon black also provides a useful colorant.

The colorants may be present in the toner over a wide range such as from about 1 to about 20 weight % of the toner. Good results are typically obtained when the amount is from about 1 to about 10 weight % of the toner.

Further, charge control agents suitable for use in the toners are disclosed, for example, in U.S. Pat. Nos. 3,893,935; 4,079,014; and 4,323,634. Charge control agents are generally employed in small quantities, such as from about 0.10 to about 3 weight % of the toner and are more typically used in quantities from about 0.2 to about 2.5 weight %. Typically, the toner images are formed, as known to the art, by the use of carriers. Most carriers known to those skilled in the art are suitable for the formation of the color images.

No novelty is claimed in the toners used to form the color image on the substrate. These toners are conventional and are conventionally applied as known to those skilled in the art to form a black and white or a different or multi-color image. The image may be developed as known to those skilled in the art.

A belt glossing device 10 is shown in the FIGURE. This showing is schematic only and discloses only the features necessary to achieve the operational steps described. The glossing device 10 is shown as an independent apparatus located in operative association with a conventional color printer 100, such as for example an electrophotographic printer having multiple color imaging units 101–105. The imaging units 101–105 respectively provide color toner images on a substrate transported by, for example, a transport web 110. The transport web then directs the image bearing substrate to a heat/pressure fuser 112 to fuse the image to the substrate. Thereafter, the substrate bearing the fused image can be transported to the glossing device 10, or to other output devices (not shown) for the color printer 100. Of course other printer types and configurations are suitable for use with this invention, and the glossing device 10 could alternately be integral with, or within the housing of, the printer 100.

Prefused substrates 12 are transported seriatim to a fusing section of the glossing device 10. The fusing section includes a fuser roller 16, which may include a heater 18, and a pressure roller 20. The substrates 12 are passed between rollers 16 and 20 and adhere to a belt 22, which is entrained about roller 16 and roller 24. As the substrates leave the fusing section between rollers 16 and 20 they are retained on belt 22 and allowed to cool. A cooling source is shown schematically by arrows 26 and may be provided by any suitable mechanism, such as pressurized air, cooled air, or the like. As the substrates cool, the prefused toner images thereon become more viscous and have enhanced elasticity. As a result when belt 22 passes around roller 24, the substrates are released and collected for conveyance to a storage area or the like. Roller 24 is desirably of a relatively small diameter with respect to roller 16. As such, the separation of the substrates from the belt 22, are facilitated. The operation of such systems is well known to those skilled in the art.

As discussed above, the presence of release oil on the fuser 112 of the printer 100 to inhibit the transfer of toner from a substrate onto the surface of the fuser can result in numerous detrimental affects as the substrates pass onward to the belt 22, and can cause image defects and/or damage to the printer 100.

According to the present invention, a clear toner layer positioned over the color toner image substantially eliminates oil-induced artifacts/damage. The clear toner layer is of a basic conventional composition, but without the presence of any colorant. Further, this clear toner desirably includes from about 2.5 to about 10 weight % of an aliphatic, olefinic, hindered or unhindered ester wax having a molecular weight of typically less than about 2000. This material serves readily to prevent the clear toner from adhering to the surface of the fuser roller of the color printer 100 and surfaces of the glossing device 10, and enables the glossing device to produce a high gloss image without defects.

The ultimate gloss of the image is determined to a large extent by the surface finish of the belt 22 of the glossing device 10. Typically the gloss of the images produced using a conventional fuser system is less than about 20 measured by the Glossgard II 20° glossmeter as discussed below. By the use of the belt 22 of the glossing device 10, which can have a high gloss surface that results in the presence of a high gloss image on the substrate, the gloss can be from about 20 to about 100, and is desirably from about 50 to about 100.

Typically, the pre-fused toner image on a substrate is brought into pressure contact with the surface of the belt 22 in the fusing zone of glossing device 10. The temperature applied to fuse the toner particles causes the particles to fuse into a sintered mass that adheres to the substrate. Due to the relative flow characteristics of such toner particles, the sintered mass has an uneven or rough surface of low surface reflectivity. Typically temperatures used in the fusing zone are less than about 200° C. and generally in the range of about 140° to 180° C. The pressures used in combination with the aforementioned fusing temperatures include those conventionally employed in contact fusing processes. They are generally in the range of about 3 $kg/cm^2$ to about 15 $kg/cm^2$ and are often about 10 $kg/cm^2$.

The belt 22 employed in the practice of this invention can be in any physical form suitable for applying heat in a face-to-face relationship with a toner pattern on a substrate, and maintaining that relationship through a cooling zone until separation of the substrate from the belt. Belt 22 is typically a continuous belt, although it could be in the form of a series of interconnected plates. A continuous belt is preferred because this provides a straight, flat transport path that reduces curl problems that can be introduced into the image bearing substrate by a roller. The surface of the belt 22 is generally smooth, although a texture surface can be used if the surface is not so rough that it reduces the overall gloss of the fused toner pattern to an undesirable level. When a continuous belt is employed, the belt must be reasonably flexible and heat resistant. It is preferably made with a material such a stainless steel or polyester that meet such criteria, such as a polyimide sold under the tradename of KAPTON. The outer surface of the belt 22 which contacts the toner image can include any of the materials known in the prior art to be suitable for use in such fusing surfaces, including aluminum, steel, various alloys as well as polymeric materials such as thermoset resins. Fusing members (belts) with fluoroelastomer surfaces can improve the release characteristics of the fuser member.

In the practice of this invention, the substrates bearing the toner images are cooled in a cooling zone, between the roller 16 and the roller 24, to a level where they readily release from the belt without toner image transfer (offset) to the surface of the belt. In the cooling zone, cooling of substrates bearing fused toner images is controlled so that the substrates can be released at a temperature where no toner image offset occurs. As previously indicated, cooling can conveniently be controlled simply by adjusting the velocity or flow of impringing air upon the belt 22, as illustrated in the FIGURE, although other cooling mechanisms such as a chill roll or plate could be used in place of air impingement. When a continuous belt is used as the fusing member, it usually is not necessary to press the element against the fusing member to maintain contact between the fusing member and the fused toner image because the image is heated in the fusing zone to a point where the fused image surface acts as an adhesive which temporarily bonds to the fusing member as the fused toner image moves through the cooling zone.

In the area of substrate release, the fused toner image is separated from the fusing belt 22. Such release is not affected until the belt 22 is cooled to a temperature where no toner image offset occurs. Such temperature is typically no more than about 75° C. and is normally in the range of about 30° to 60° C. The specific temperature used to achieve such separation will vary considerably as it depends upon the flow properties of the toner particles. The release temperature chosen is such that the toner image adheres to the substrate and exhibits sufficient cohesiveness that it will not offset onto the belt 22 at the particular temperature used i.e., there is no significant transfer of toner image to the belt. Upon separation from the belt 22 in the release zone, the fused toner image exhibits a degree of gloss that will vary considerably depending upon the specific processing conditions such as amount and duration of pressure and temperature and the viscoelastic characteristics of the toner particles used in of this invention. However, the gloss levels for fused toner images formed in this invention are typically at least 20 (in units of measure discussed below) and often in the range of about 50 to 100. Such gloss levels are readily perceptible to the unaided eye, but they can be measured by a specular glossmeter at 20° using conventional techniques well known to those skilled in the art for this purpose, for example, the method described in ASTM-523-67.

A typical gloss measurement method utilizes a single reflectivity measurement, as of a type that measures the amount of light from a standard source that is specularly reflected in a defined path. A suitable device for this purpose is a Glossgard II 20° glossmeter (available commercially from Pacific Scientific, Inc., Silver Springs, Md.) which produces a reading on a standardized scale, of a specularly reflected ray of light having angles of incidence and reflection of 10° to the normal. The standard scale of such meter has a range from 0 to 100, the instrument being normally calibrated or adjusted so that the upper limit corresponds to a surface that has substantially less than the complete specular reflection of a true mirror. Reflectivity readings are indicated as gloss numbers.

This invention provides not only fused toner images having enhanced gloss, but it can also provide transparencies having colored toner images on transparent substrates, which images exhibit good color clarity. As known to those skilled in the art, color clarity can be defined as the ratio of specular to total transmitted light expressed in percent. Such color clarity can be conveniently determined by placing an image on a transparent substrate in an optical light path and separately measuring, or reading, the specular and totally transmitted light with a suitable device, e.g., a photometer.

Various conductive or nonconductive materials can be used as substrates for the toner images fused according to this invention. Such substrates are well known to those skilled in the art and include various metals such as aluminum and copper and metal-coated plastic films as well as organic polymeric films and various types of paper. Polyethylene terephthalate is an excellent transparent polymeric support use in forming transparencies.

By the present invention with the use of the clear toner layer containing wax, it is not necessary to use release oils on the fuser roller in the printing apparatus 100 or in the glosser device 10. This eliminates the surface image artifacts and machine defects caused by the presence of release oils. As well known, any or all of the colored toners can be used in the formation of a particular image on a substrate. Desirably, the belt 22 in the glossing device 10, is a flat, smooth belt that produces a smooth, high gloss image on the substrate. The substrate is cooled before it is released from the belt 22 by virtue of the curvature of the belt as it moves around roller 24. Typically the gloss levels produced may be as high from about 50 to about 100.

As discussed, according to the present invention, it is unnecessary to use release oils at the fuser roller of the printing apparatus 100 (or the glossing device 10), since the clear toner layer includes waxes that provide the required free release of the images. This process provides improved gloss characteristics to the images on the substrate as well as avoiding the problems resulting from the use of release oil. In operation of the printing apparatus 100, where modes of operation dictate that a clear toner layer (including waxes) is to be applied to enable gloss of the reproduction output to be substantially increased, the fuser of the printing apparatus is controlled by a central processing unit to turn off application of release oil. Conversely, when no clear toner layer is to be used, or where a clear layer not including waxes is to be utilized, the central processing unit (CPU) assures that the application of release oil continues during such mode of operation.

While the present invention has been described by reference to certain of its preferred embodiments, it is pointed out that the embodiments described are illustrative rather than limiting in nature and that many variations and modifications are possible within the scope of the present invention.

Many such variations and modifications may be considered obvious and desirable by those skilled in the art based upon a review of the foregoing description of preferred embodiments.

What is claimed is:

1. A method for selectively producing an enhanced gloss toner image on a substrate, the method comprising the steps of:

a) turning off application of release oil to a fuser in a printer;

b) coating colored fusible toner particles supported on a substrate with a layer of clear toner containing an offset preventing wax;

c) transporting the substrate bearing clear toner coated colored fusible toner particles through a fuser zone to fuse the fusible toner particles and produce a substrate bearing a fused clear coated toner image; and d) transporting the substrate bearing the clear coated fused toner image through downstream glossing device to re-fuse the fused toner image to increase the gloss of the previously fused toner image.

2. The method of claim 1, wherein the fusible toner particles are re-fused in the downstream glossing device at a temperature below about 200° C.

3. The method of claim 1, wherein the fusible toner particles are re-fused in the downstream glossing device at a temperature from about 140° to about 180° C.

4. The method of claim 1, wherein the fusible toner particles are re-fused in the downstream glossing device at a pressure from about 3 to about 15 $kg/cm^2$.

5. The method of claim 1, wherein the cooled substrate bearing the fused image is released from the glossing device at a temperature from about 30 to about 75° C.

6. The method of claim 1, wherein the gloss level of the image on the cooled substrate bearing an enhanced gloss image is from about 20 to about 100.

7. The method of claim 1, wherein the gloss level of the image on the cooled substrate bearing an enhanced gloss image is from about 50 to about 100.

8. The method of claim 1, wherein the clear toner contains from about 2.5 to about 10 weight % of an aliphatic, olefinic, hindered, or unhindered ester wax.

9. The method of claim 8, wherein the aliphatic, olefinic, hindered or unhindered ester wax has an average molecular weight less than about 2000.

10. A method for selectively producing an enhanced gloss toner image on a substrate provided by a printer, the method comprising:

a) determining whether an enhanced gloss toner image is desired;

b) if an enhanced gloss toner image is desired, turning off application of release oil to a fuser in said printer, coating colored fusible toner particles supported on a substrate with a layer of clear toner containing an offset preventing wax, transporting the substrate bearing clear toner coated colored fusible toner particles through a fuser zone to fuse the fusible toner particles and produce a substrate bearing a fused clear coated toner image, and transporting the substrate bearing the clear coated fused toner image through downstream glossing device to re-fuse the fused toner image to increase the gloss of the previously fused toner image; and c) if an enhanced gloss toner image is not desired, supplying release oil for application to said fuser of said printer.

11. A glossing device system for selectively producing an enhanced gloss toner image of colored fusible toner particles fused on a substrate in a printer, said glossing device system comprising:

a glossing device fuser having a member for enhancing a gloss of a toner image; and a control for enabling turning off rlease oil to said fuser of said printer and coating colored fusible toner particles supported on a substrate with a layer of clear toner containing an offset preventing wax, transporting the substrate bearing clear toner coated colored fusible toner particles through a fuser zone to fuse the fusible toner particles and produce a substrate bearing a fused clear coated toner image, and transporting the substrate bearing the clear coated fused toner image through downstream glossing device to re-fuse the fused toner image to increase the gloss of the previously fused toner image, when an enhanced gloss toner image is desired, and when an enhanced gloss toner image is not desired, making sure release oil is supplied to said fuser of said printer.

12. The system of claim 11 wherein said glossing device fuser includes a smooth continuous belt.

13. The system of claim 11 wherein said glossing device is an independent piece of equipment operatively associated with said printer.

14. The system of claim 11 wherein said glossing device is integral with said printer.

15. The system of claim 11 wherein said glossing device is within the housing of said printer.

* * * * *

UNITED STATES PATENT AND TRADEMARK OFFICE

CERTIFICATE OF CORRECTION

PATENT NO. : 7,058,348 B2
APPLICATION NO. : 10/896396
DATED : June 6, 2006
INVENTOR(S) : Muhammed Aslam et al.

It is certified that error appears in the above-identified patent and that said Letters Patent is hereby corrected as shown below:

| | |
|---|---|
| Col. 4, line 28 | replace “printer 100” with --glossing device 10-- |
| Col. 5, line 13 | replace “a” with --as-- |
| Col. 5, line 32 | replace “impringing” with --impinging-- |

Signed and Sealed this

Sixth Day of February, 2007

JON W. DUDAS
*Director of the United States Patent and Trademark Office*